United States Patent [19]

Gentili

[11] 3,996,728

[45] Dec. 14, 1976

[54] APPARATUS FOR WRAPPING PAPER REAMS AND THE LIKE IN SHEETS CUT OFF A CONTINUOUS PACKING WEB AND FOR ADJUSTING THE SIZE OF SUCH SHEETS ACCORDING TO THE REAM SIZE

[76] Inventor: Vittorio Gentili, Via Caprarie, 3, Bologna, Italy

[22] Filed: Dec. 10, 1975

[21] Appl. No.: 639,554

[30] Foreign Application Priority Data

Dec. 13, 1974 Italy ..... 3566/74

[52] U.S. Cl. ..... 53/389; 53/66

[51] Int. Cl.[2] ..... B65B 41/12

[58] Field of Search ..... 53/389, 66

[56] References Cited

UNITED STATES PATENTS

| | | | |
|---|---|---|---|
| 3,274,870 | 9/1966 | Schmermund | 53/389 X |
| 3,791,100 | 2/1974 | Monaghan | 53/389 X |

*Primary Examiner*—Travis S. McGehee

*Attorney, Agent, or Firm*—Guido Modiano; Albert Josif

[57] ABSTRACT

The apparatus comprises a ream conveyor, two chains means for driving the chains such that those portions thereof which are adjacent the conveyor outlet end are moving upwards from below. Means are provided to guide the packing web material. Locking members are provided to selectively retain the packing web material. A blade or cutting edge is provided for cutting across the web material when the latter is retained by the locking members. Switch members are displaced along the chain path and actuated by elements integral with the chains. The elements are adapted to control the chain drive means in order to stop the chains when a predetermined length of web material has been unwound, then to determine the releasing mode thereof, and to allow the web material stretching along a vertical wall. Pad means are provided for holding the packing web material termination against a vertical wall.

7 Claims, 7 Drawing Figures

A
B
C
R

APPARATUS FOR WRAPPING PAPER REAMS AND THE LIKE IN SHEETS CUT OFF A CONTINUOUS PACKING WEB AND FOR ADJUSTING THE SIZE OF SUCH SHEETS ACCORDING TO THE REAM SIZE

BACKGROUND OF THE INVENTION

This invention relates to an apparatus for wrapping paper reams and the like in sheets cut off a continuous packing web and for adjusting the size of such sheets according to the reams sizes.

In the packing art, and especially of paper reams, the problem of varying the packing sheet size to suit the ream size is yet to receive a satisfactory solution. In fact, the current practice of wrapping paper reams in packing sheets requires the availability of packing sheets prearranged in stacked packages. Indeed, it has been proposed to prepare such sheets from a continuous web or ribbon coiled into a roll for subsequent delivery, but in this case the adjustment of the sheet size did involve a rather complex procedure offering little scope for improvements aimed at ensuring production rates in keeping with the most up-to-date requirements.

SUMMARY OF THE INVENTION

Thus, it is an object of this invention to provide an apparatus whereby the wrapping of the reams in packing sheets and the adjustment of the latter size have been approached in a rational manner.

It is another important object of this invention to provide such an apparatus having a simple construction, and being accordingly economical to manufacture in relation to its application potentialities and the performance level achieved.

These and other objects, such as will be more apparent hereinafter, are achieved by an apparatus characterized in that it comprises a ream conveyor, a first shaft supported downstream of said conveyor and below the ream supporting surface, said first shaft being arranged transversally with respect to the ream direction of advance, a second shaft supported parallel to said first shaft above the ream supporting surface, a first pair of sprocket wheels supported on said first shaft, and a second pair of sprocket wheels supported by said second shaft, the sprocket wheels of one pair being coplanar with the sprocket wheels of the other pair, two chains passed around the coplanar sprocket wheels, the sprocket wheels of each pair being spaced apart by a distance which is greater than the width of the web material wherefrom the sheets are being cut, a plurality of parallel rollers, each having their opposite ends supported idle in said chains, a means for driving the chains such that those portions thereof which are adjacent the conveyor outlet end are moving upwards from below, said portions extending in a substantially vertical plane, a vertical wall extending in a plane tangent to the rollers which are located at the chains upward moving runs, a pair of rotating drive rollers supported downstream of said upward moving runs and spaced apart such as to have tangent planes in alignment with the upper and lower faces of the reams, a means effective to guide the packing web material between said idle rollers and said drive rollers, and arranged to reciprocate in a vertical direction, locking members positioned on said bar and effective to retain the packing web material when the bar is at its lower stroke limit, a blade or cutting edge secured to said bar for cutting across the web material when the latter is retained by said locking members, switch members displaced along the chain path and actuated by elements integral with the chains, said elements being adapted to first control the chain drive means in order to stop the chains when a predetermined length of web material has been unwound by the idle roller directly underneath it, then the bar driving means in order to determine the releasing mode thereof, and lastly again the chain drive means to allow the web material to be stretched along said vertical wall, there being finally provided a pad means for holding the packing web material termination against said wall.

BRIEF DESCRIPTION OF THE DRAWINGS

Further features and advantages of the instant invention will become more apparent from the following detailed description of a preferred, though not exclusive, embodiment thereof being illustrated by way of example and not of limitation in the accompanying drawings, wherein.

DESCRIPTION OF THE PREFERRED EMBODIMENT

Figures 1, 2, 3:
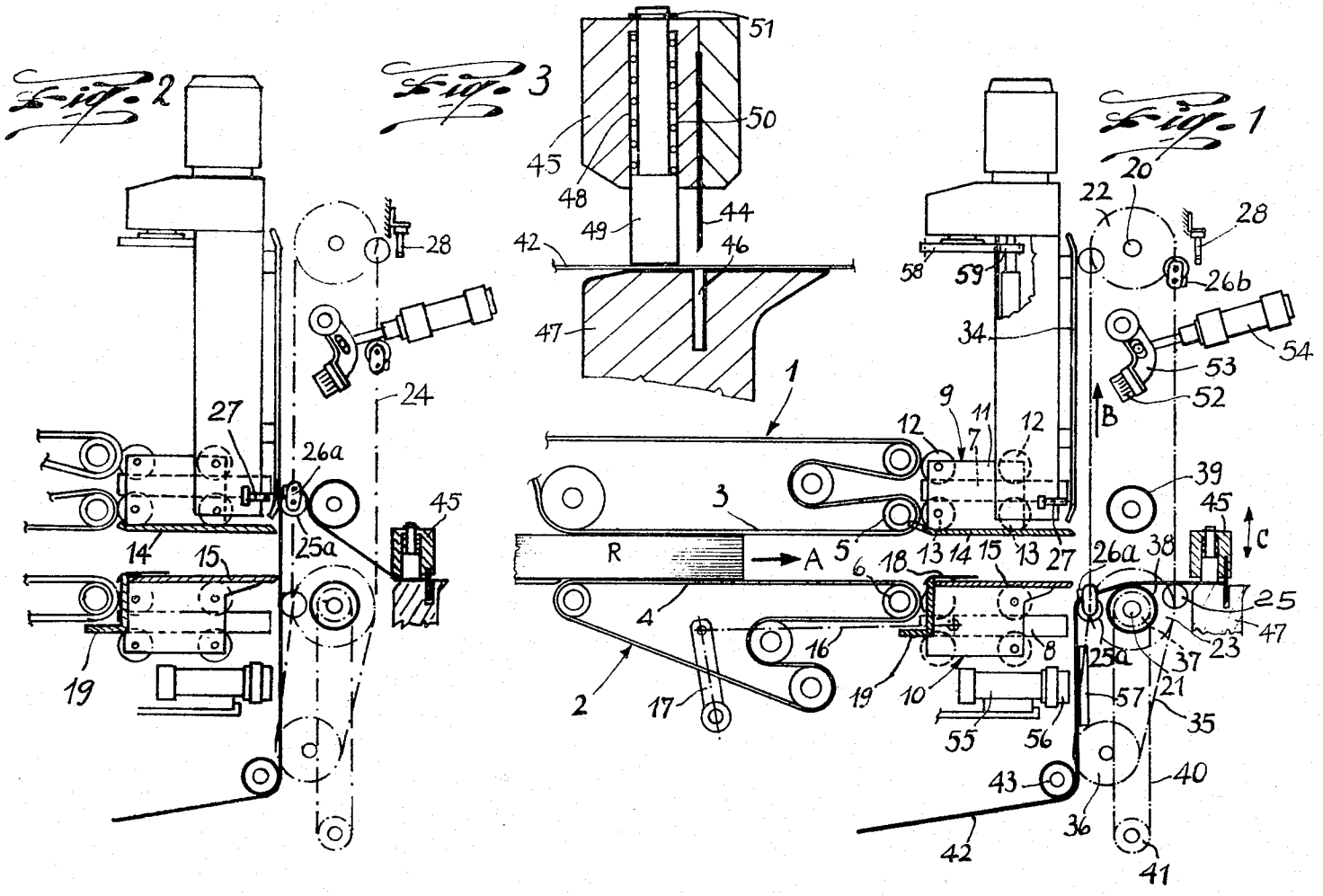
FIG. 1 is a partially schematic longitudinal elevation view of the instant apparatus, shown in an operative position.
FIG. 2 shows the apparatus of FIG. 1 in a subsequent operative position thereof.
FIG. 3 shows a detail portion of the apparatus in FIG. 1.

With reference to the accompanying drawing figures, the instant apparatus comprises a pair of belts 1, 2 circulating over and around rollers such as to present two parallel and superimposed portions 3, 4 (see FIG. 1). The belts 1, 2 are driven such that the portions 3, 4 move both in the same direction, as indicated by the arrow A.

Downstream of the rollers 5, 6 and arranged at the terminations of the portions 3, 4, upper guides 7 and lower guides 8 are provided which are parallel to one another and support respective carriages 9, 10 comprising each a plate 11 and wheel pairs 12, 13 which are grooved peripherally and engage the top and bottom of each guide 7, 8.

In regard to what does not appear illustrated in detail, it will appear obvious that the guides 7 (and similarly the guides 8) are provided as two in number, each of them being arranged on one respective longitudinal side of the apparatus and supporting each one carriage 9. The upper carriages 9 are interconnected by cross-members extending perpendicularly to the direction A and to shelves 14 formed by metal plates welded lowerly to the plates 11. Similarly, between the lower carriages 10, there extend shelves 15 which are coplanar with the portions 4 of the belt 2 interconnecting together said carriages 10 and facing the shelves 14. The guides 7 are supported in the machine frame such as to be adjustable in height, thereby it becomes feasible to vary the level of the carriages 9 with respect to the carriages 10 level in order to adjust the spacing between the shelves 14, 15 according to the thickness of the ream being transferred.

One end of a connecting rod 16 is journalled to the carriages 10, the opposite end whereof is pivoted to a reciprocating arm 17. It should be noted that, downstream of the roller 6, there extends transversally to the apparatus a metal plate 18 which is coplanar with the lower portions 4 and supported by shoulders 19 integral with the machine frame.

The shelf 15, as supported by the carriages 10, slides under the metal plate 18 owing to the reciprocation of the arm 17. Thus, there is formed under the reams R a sliding and supporting surface which is substantially continuous, although its width may be varied, and effective to provide an unobstructed forward motion for the reams without creating difficulties for the return stroke of the shelf 15.

The carriages 9 are coupled to the carriages 10 such as to follow the movement thereof. It is also possible to drive the carriages 9 simultaneously with the carriages 10, by means of a suitable driving means.

Downstream of the carriages 9, 10, two parallel and horizontal shafts 20, 21 are located which extend in a vertical plane whereto the direction A is perpendicular. Such shafts are journalled to the frame, and a pair of sprocket wheels 22, 23 are affixed to each of them for driving two continuous chains 24.

Figure 4:
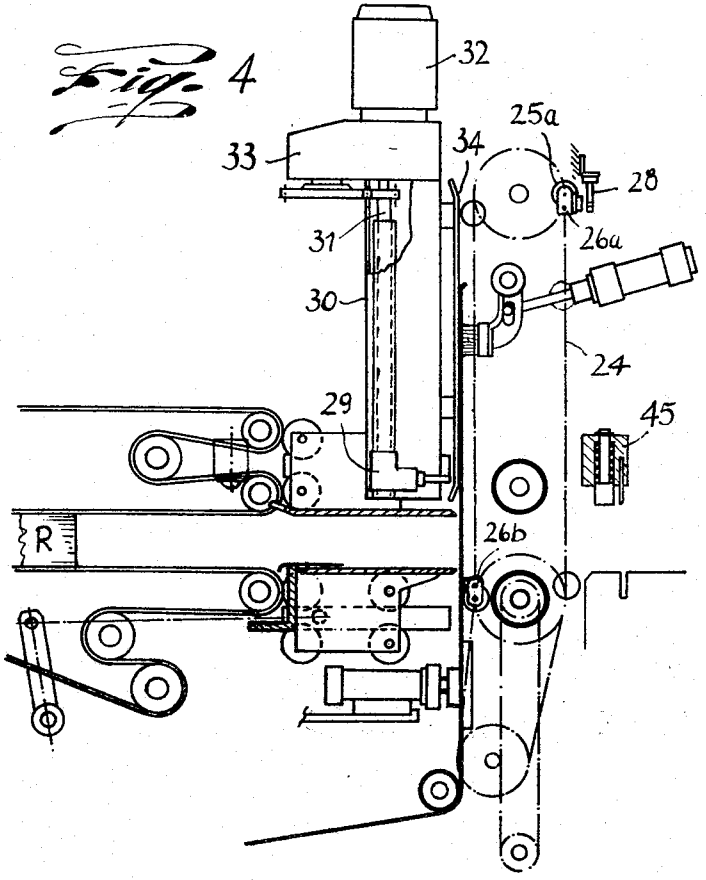
FIG. 4 shows the apparatus in a third operative position.

Between the chains 24 and equally spaced apart, there are arranged pairs of parallel rollers 25. Furthermore, two blocks 26a,26b are secured to one chain which are effective to influence two switches 27, 28 of the induction type, which control the drive for the chains 24. The switch 28 is mounted to the frame, in the proximity of the upper sprockets 22, while the switch 27 is secured to a threaded bushing 29 (see FIG. 4), which is guided vertically within a column or upright 30 and engaged by a threaded bar 31 pivotally supported by that same column or upright.

An electric motor 32 is installed at the top of the column which, through a reduction gear 33, imparts a rotary motion to the bar or rod 31, thus permitting the switch 27 to be raised and lowered.

The numeral 34 identifies a wall which extends vertically and transversally between the column 30 and chains 24.

The chains 24 are driven in the direction of the arrow B by a drive system including a chain 35 driven by a sprocket wheel 36 and engaging a sprocket wheel keyed to the shaft 21 (which, in FIG. 1, is the same as the sprocket wheel 23). Said shaft 21 also supports pivotally a sprocket wheel 37 affixed to a roller 38 extending transversally from the apparatus and tangentially to the extension of the shelf 15. A second roller 39 cooperates with said roller 38 which is supported between the upward moving and downward moving runs of the chains 24, such as to be at all times tangent to the extension of the shelf 14. The rollers 38, 39 are interconnected kynetically such as to rotate, the former in a clockwise direction and the latter in a counterclockwise direction, and push in the direction A the reams B inserted therebetween. The roller 39 may be an idle roller. The drive for the rollers 38, 39 is achieved through a chain 40 which circulates around the sprocket wheel 37 and a drive sprocket wheel 41.

The sheet whereinto paper reams must be wrapped is withdrawn from a continuous web material or ribbon 42 directed by a roller 43 such as to move upwards coplanarly with the wall 34 as high as the shelf 15 level. The ribbon 42 also extends through the two chains 24 and rests on the roller 38, and is each time cut into sheets having dimensions which are adequate for the size of the reams by a blade or cutting edge 44 (see also FIG. 3) affixed to a cross bar 45, in turn driven to reciprocate in a vertical direction, as indicated by the double arrow-head C. The blade 44 is adapted to penetrate a slot 46 of a fixed abutment member 47. A plurality of cylindrical recesses 48 is formed in the bar 45, wherein cylinders 49 are received slidably. Between one shoulder of the cylinders 49 and the bottom of their respective recesses a cylindrical coil spring 50 is interposed which operates in compression and urges the cylinders 49 downwards as far as a stroke limit represented by an abutment ring 51 engaged with that end of the cylinders which projects above the bar 45. As the cylinders are positioned outside of the recesses 48, they protrude downwardly beyond the cutting edge of the blade 44, such as to contact the fixed abutment member 47 ahead of the blade itself.

When, as it will be apparent hereinafter, the termination of the ribbon 42 is arranged vertically in contact with the wall 34, it is retained in such a position by a brush 52 which is supported by arms 53 pivotally connected to the apparatus frame and subjected to the action of a fluido-dynamic cylinder 54. The apparatus just described is completed with a further fluido-dynamic cylinder 55, located underneath the carriages 10, to the rod whereof a pad 56 is affixed which is effective to hold or retain the ribbon 42, running in front of it, against a fixed wall 57.

Figure 5:
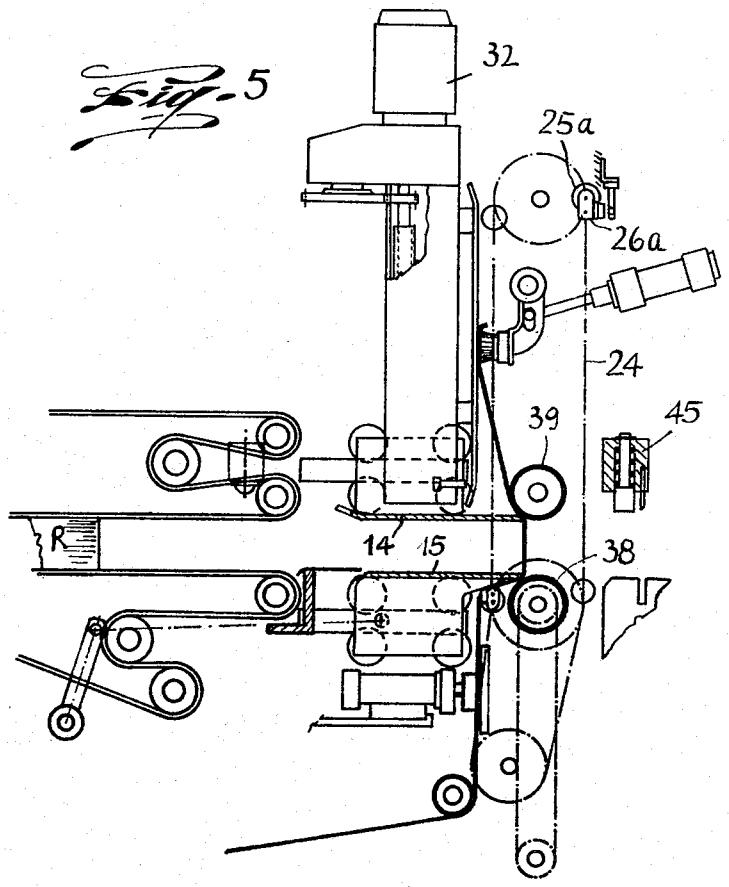
FIG. 5 shows the apparatus in a fourth operative position.
Figures 6, 7:
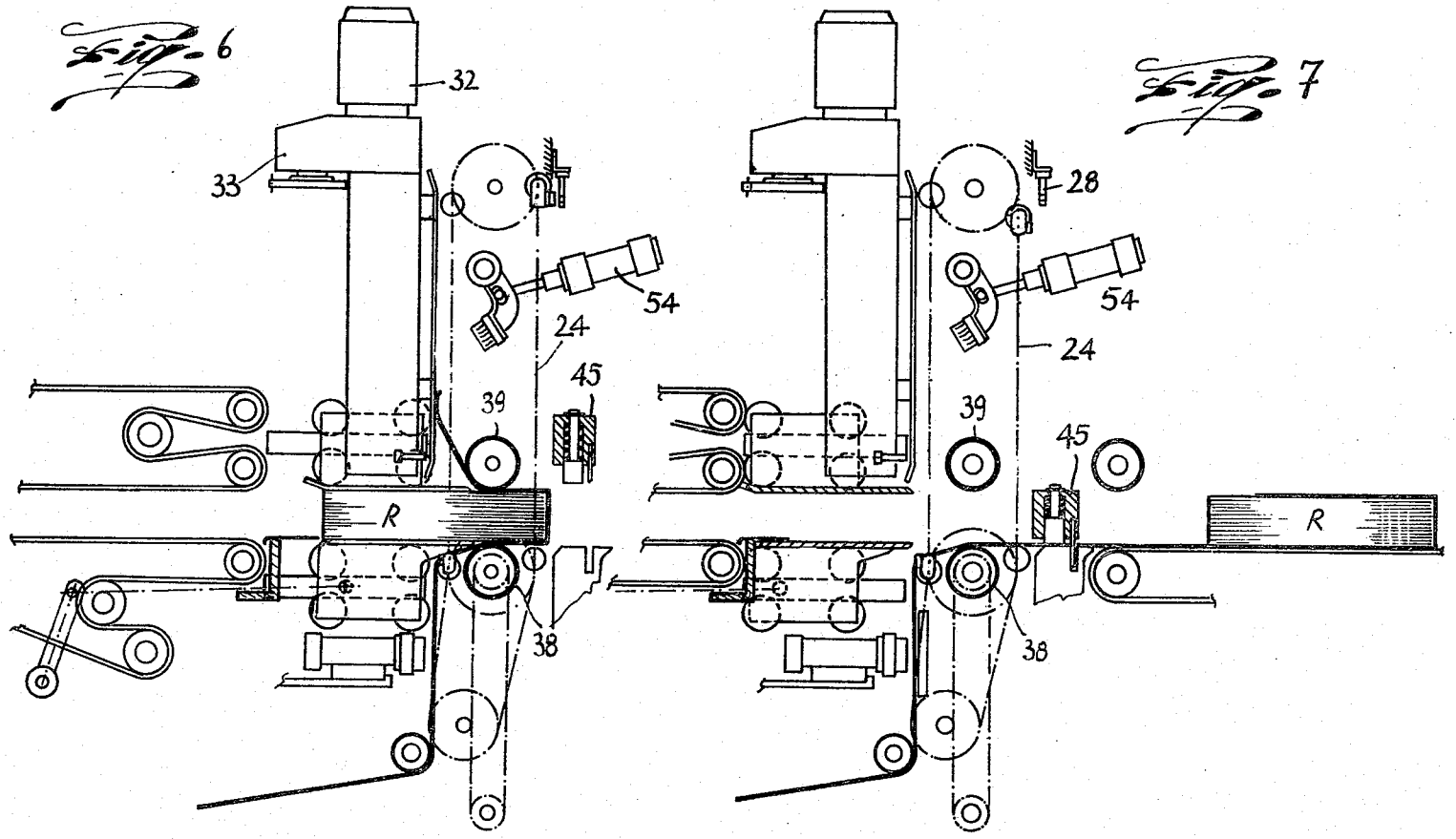
FIGS. 6 and 7 show the apparatus in a fifth and sixth operative position, respectively.

The apparatus operation is the following. It is assumed that the start or initial condition shown in FIG. 1, wherein the ribbon 42 termination extends between the chains 24 and has its end clamped between the cylinders 49 and fixed abutment 47, may be taken for obvious. By actuating the chain mechanism, the roller directly underlying the ribbon 42, identified with **25*a* in FIG. 1, raises the ribbon or web material 42 which unwinds until the block 26*a*, secured level with the roller 25*a*, reaches the switch 27 (FIG. 2). The switch 27 is thus activated and causes the bar 45 to be raised, thereby the end of the ribbon 42 is released. Simultaneously with the raising of the bar 45, the cylinder 55 is activated and the ribbon 42 is clamped against the wall 57. As the chain mechanism is further operated, the termination of the ribbon 42 is stretched along the vertical wall 34, and held thereat by the brush 52, lowered onto it, after the roller 25*a* has moved further forward (the position in FIG. 4). As the block 26*a* reaches the switch 28, the chains 24 are brought to a stop, while the block 26*b* finds itself at the position occupied initially by the block 26*a*, i.e. the diagonally opposed one. At this point, the shelves 14, 15 move forward, and by penetrating between two rollers 25 adjacent each other, partly withdraw the upper portion of the ribbon, while the lower portion of the ribbon 42 is still retained by the cylinder 55 (the position shown in FIG. 5). The shelves 14, 15 are made to advance until their forward ends are brought nearly underneath the rollers 38, 39. Following the removal of the clamping action on the ribbon 42 by activating the cylinder 55 and withdrawing the pad 56, the ream is inserted between the shelves 14, 15 and pushed onwards. The leading edge of the ream, after striking the ribbon 42 which is stretched vertically between the forward edges of the shelves 14, 15 is gripped in the nip of the rollers 38, 39 (see FIG. 6) and pushed onwards until the ream moves past the bar 45 (see FIG. 7). The ribbon is now retained by lowering the cylinders 49 against the abutment member 47, and cut downstream of the bar by means of the blade 44. Thus, the position of FIG. 1**, or starting position, is resumed and the cycle may repeat itself as specified above.

It will noted that the invention thus achieves in full the objects intended. In order to adjust the length of the sheets cut off the web material, wherein the ream is to be wrapped, all that is required is to shift the height of the switch 27 such as to vary the stop point for the ribbon 42 drive roller 25*a*, and accordingly the length of ribbon withdrawn before the opening of the blade 45.

It should be further noted that, thanks to the inventive apparatus, the packing sheet encloses the upper and lower faces of the ream in a U type of configuration, and that the packing operation is completed by another apparatus located downstream with respect to the bar 45 and operating on quite conventional principles.

Advantageously, the switch 27 height adjustment is performed by means of a count type of control, e.g. of the type including a disc 58 provided with peripheral indentations and meshing with a gear wheel 59 keyed to the threaded bar or rod 31. Such a disc 58 is provided with a plurality of peripherally arranged holes at equal intervals, wherewith a photoelectric type of coupling cooperates which, after detecting a given number of pulses proportional to the number of revolutions made by the disc 58, and accordingly by the threaded rod 31, compares them with a previously set number suitably related to the desired length of the packing sheets for the reams, thus switching off the motor 32.

I claim:

1. An apparatus for wrapping paper reams and the like in sheets cut off a continuous packing web and for adjusting the size of such sheets according to the ream sizes, characterized in that it comprises a ream conveyor, a first shaft supported downstream of said conveyor and below the ream supporting surface, said first shaft being arranged transversally with respect to the ream direction of advance, a second shaft supported parallel to said first shaft above the ream supporting surface, a first pair of sprocket wheels supported on said first shaft, and a second pair of sprocket wheels supported by said second shaft, the sprocket wheels of one pair being coplanar with the sprocket wheels of the other pair, two chains passed around the coplanar sprocket wheels, the sprocket wheels of each pair being spaced apart by a distance which is greater than the width of the web material whereoff the sheets are being cut, a plurality of parallel rollers, each having their opposite ends supported idle in said chains, a means for driving the chains such that those portions thereof which are adjacent the conveyor outlet end are moving upwards from below, said portions extending in a substantially vertical plane, a vertical wall extending in a plane tangent to the rollers which are located at the chain upward moving runs, a pair of rotating drive rollers supported downstream of said upward moving runs and spaced apart such as to have tangent planes in alignment with the upper and lower faces of the reams, a means effective to guide the packing web material between said idle rollers and said drive rollers, a transversally supported bar downstream of said drive rollers and arranged to reciprocate in a vertical direction, locking members positioned on said bar and effective to retain the packing web material when the bar is at its lower stroke limit, a blade or cutting edge secured to said bar for cutting across the web material when the latter is retained by said locking members, switch members displaced along the chain path and actuated by elements integral with the chains, said elements being adapted to first control the chain drive means in order to stop the chains when a predetermined length of web material has been unwound by the idle roller directly underneath it, then the bar driving means in order to determine the releasing mode thereof, and lastly again the chain drive means to allow the web material stretching along said vertical wall, there being finally provided a pad means for holding the packing web material termination against said wall.

2. An apparatus according to claim 1, characterized in that it comprises slide members arranged to slide horizontally between the ream conveyor outlet end and the idle roller supporting chains, said slide members supporting a pair of horizontal and parallel shelves coplanar with the upper and lower faces of the reams to be packed, said slide members being further driven to reciprocate between a position whereat the shelves are contiguous with the conveyor outlet end and a position whereat the forward edges of the shelves are in close proximity of the drive roller pair downstream of the upward moving chain runs.

3. An apparatus according to claim 2, characterized in that said switch members are arranged at positions lying diagonally opposite on said chain and at least one of them is adjustable in height.

4. An apparatus according to claim 3, characterized in that said adjustable height member is affixed to an element coupled, in turn, to a threaded rod or bar driven by an electric motor.

5. An apparatus according to claim 2, characterized in that said bar comprises a plurality of recesses wherein cylinders are arranged which slide vertically against biassing drive means, said cylinders being effective to retain the web material against a fixed detent.

6. An apparatus according to claim 5, characterized in that the lower shelf supported by said slide member is arranged tangentially with respect to the lower face of the ream being transferred, whereas the upper shelf is movable with respect to said lower shelf, the interval between said shelves being substantially equal to the ream thickness.

7. An apparatus according to claim 6, characterized in that said slide member is driven by a crank and connecting rod system, said crank being subjected to a reciprocating motion.

* * * * *